United States Patent [19]

Hodge et al.

[11] 3,989,162

[45] Nov. 2, 1976

[54] TRASH CONTAINER LID SYSTEM

[75] Inventors: Allan M. Hodge; Calvin P. Owen, both of San Diego, Calif.

[73] Assignee: Calvin P. Owen, San Diego, Calif.

[22] Filed: Dec. 24, 1975

[21] Appl. No.: 644,188

Related U.S. Application Data

[63] Continuation of Ser. No. 494,622, Aug. 5, 1974, abandoned.

[52] U.S. Cl. ..... 220/331; 220/1 T

[51] Int. Cl.[2] ..... B65D 43/24

[58] Field of Search ..... 220/1 T, 318, 331

[56] References Cited

UNITED STATES PATENTS

| | | | |
|---|---|---|---|
| 2,338,477 | 1/1944 | Wolters | 220/331 |
| 2,532,830 | 12/1950 | Barnhart | 220/331 |
| 2,545,959 | 3/1951 | King | 220/331 |
| 2,569,254 | 9/1951 | Pace | 220/331 |
| 2,661,119 | 12/1953 | Spiess | 220/331 |
| 3,487,887 | 1/1970 | Pensa | 220/331 |
| 3,490,642 | 1/1970 | Friedlander | 220/331 |

FOREIGN PATENTS OR APPLICATIONS

| | | | |
|---|---|---|---|
| 1,167,738 | 4/1964 | Germany | 220/331 |

*Primary Examiner*—Ro E. Hart

*Attorney, Agent, or Firm*—Richard K. Macneill

[57] ABSTRACT

A trash container lid system for placement on top of large industrial trash bins of the type utilizer in hotels, apartment houses, etc., in which a lid section is rotatably coupled to a trash bin. The lid in one embodiment is slidably coupled to the top surfaces of the side sections of the trash bin via rollers on the lid and a roller track on the top edge of the side sections and rotatably coupled to the trash bin via a lever arm rotatably coupled at one end to the trash bin and to another end to a back lower portion of the lid section.

3 Claims, 8 Drawing Figures

TRASH CONTAINER LID SYSTEM

RELATED APPLICATIONS

This application is a continuation of an application for U.S. Letters Patent filed by ALLAN M. HODGE and CALVIN P. OWEN on Aug. 5, 1974, Ser. No. 494,622 for TRASH CONTAINER LID SYSTEM, now abandoned. An application for U.S. Letters Patent was filed by co-inventor Allan M. Hodge on Feb. 8, 1973, Ser. No. 330,569, now issued as U.S. Pat. No. 3,836,036, issued on 9/17/74 for a TRASH CONTAINER LID SYSTEM. A co-pending application was filed by Allan M. Hodge on Aug. 5, 1974, Ser. No. 494,549 for TRASH CONTAINER LID SYSTEM; a co-pending application for U.S. Letters Patent was filed by co-inventor Calvin P. Owen on Aug. 5, 1974, Ser. No. 494,388 for a TRASH BIN LID.

BRIEF DESCRIPTION OF THE INVENTION

The present invention relates to a trash container lid system and more particularly to a trash container lid system having a stabilized partially open position.

According to the invention, a trash container lid system is provided which is coupled to a trash bin via a lever arm, the lever arm being rotatably coupled to the lid assembly at one end and to the trash bin at another end. The lever arm is mounted on the back areas of both the lid assembly and the trash bin so that as the lid is raised, the back portion of the lid drops, describing an arch about the point of coupling of the lever arm. In one embodiment a roller rotatably carried in the center section of the lid assembly on each side thereof rolling in a track on the top surface of the side sections of the trash bin itself for ease in lifting the lid assembly and for providing a simple stop resulting in a partially open position for emptying trash into the bin. The lid assembly is preferably counter-balanced in the back portion thereof for reducing the amount of force necessary to raise and lower the lid and for holding the lid in a partial open position and for aiding and stabilizing the partially opened position. Upon dumping the bin whereby the entire assembly is inverted over the cab of a dump truck [carried over the cab of the dump truck and inverted], the lid will fall in a vertical position with the pivot arm resting against an upward stop in one embodiment and hanging vertically with the lid in another embodiment.

An object of the present invention is the provision of an improved trash container lid assembly.

Another object of the invention is the provision of a trash container lid assembly having a stabilized partially open position.

A further object of the invention is the provision of an improved trash container lid assembly utilizing a counterweight.

Yet another object of the present invention is the provision of a trash container lid assembly which is extremely convenient in use and simple in construction.

Other objects and many of the attendant advantages of the present invention wll be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWING

Figure 1:
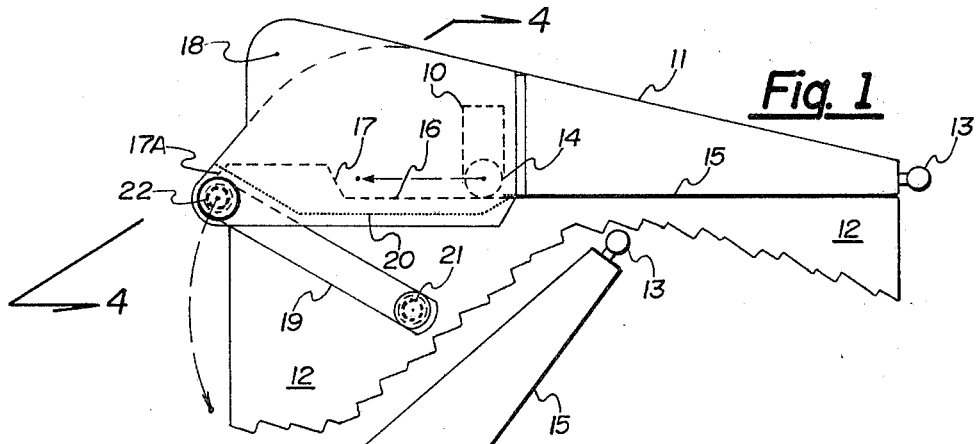
FIG. 1 is a side elevational view of a preferred embodiment of the present invention in a closed position.
Figure 2:
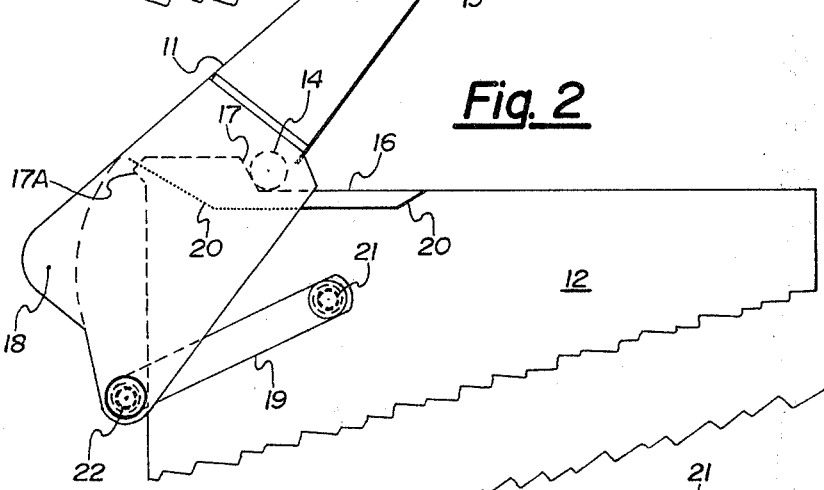
FIG. 2 is a side elevational view of the embodiment of FIG. 1 in a stabilized partially open position.
Figure 3:
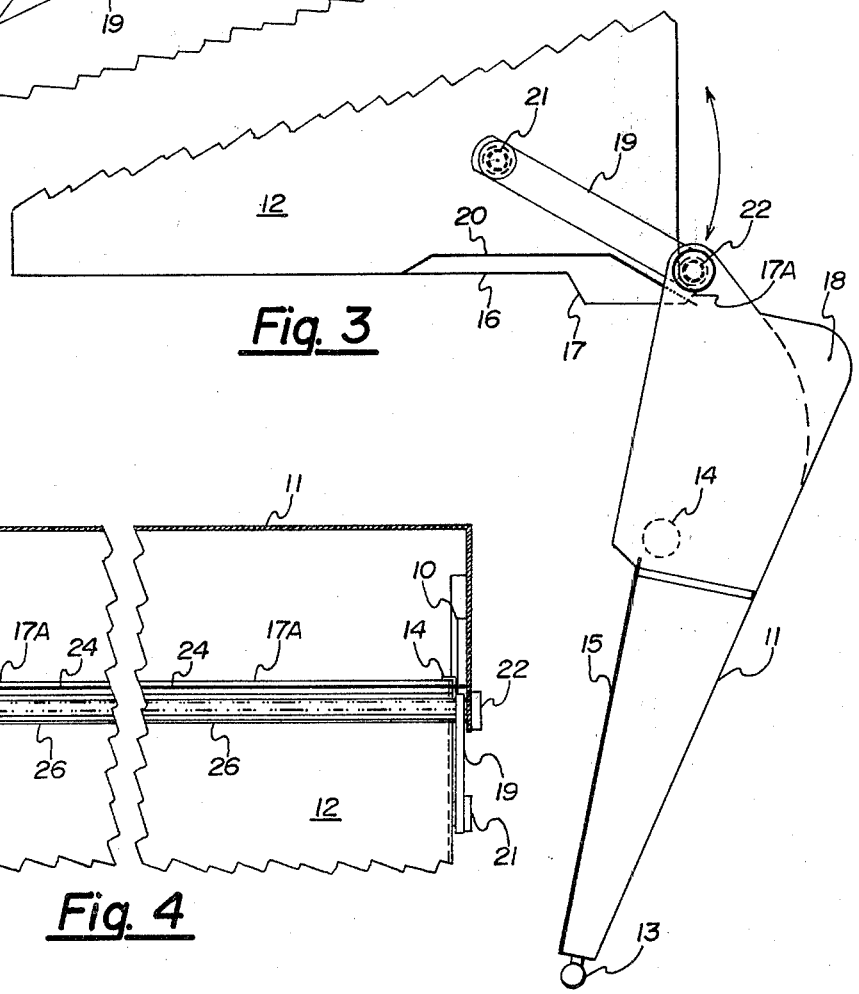
FIG. 3 is a side elevational view of the embodiment of FIG. 1 in an inverted position.

Referring to FIGS. 1, 2, and 3, a trash bin lid is shown generally at 11 in proximity with a trash bin 12. Trash bin lid 11 has a handle 13 and has a bracket 10 which rotatably carries a central roller 14 which in FIG. 1 rests on roller track 16 on the top edge of bin 12. Roller track 16 terminates in a raised portion 17 forming a stop. Lid 11 also has a counterweight section 18 of cement or some other suitable material. Lever arm 19 is rotatably coupled at pivot point 21 on trash bin 12 at one end thereof and is rotatably coupled at another end thereof at pivot point 22 at the lower rear portion of trash container lid 11.

Figure 4:
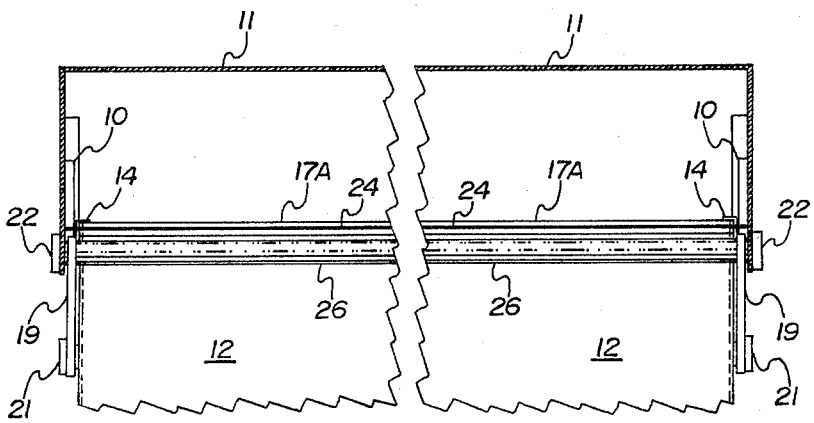
FIG. 4 is a back elevational view of the embodiment of FIG. 1 with the lid portion sectioned.

Referring to FIG. 4, lid 11 is shown disposed above the top back edge of bin 12. Lid 11 carries a bracket 10 on which center roller 14 is rotatably coupled thereto. Pivot arms 19 are rotatably coupled at one end to pivot points 21 on bin 12 and at another end to pivot points 22 on container lid 11. Seal 24 is carried by angled extension 17A at the back portion of bin 12. Tube 26 couples pivot arms 19 together.

Figure 5:
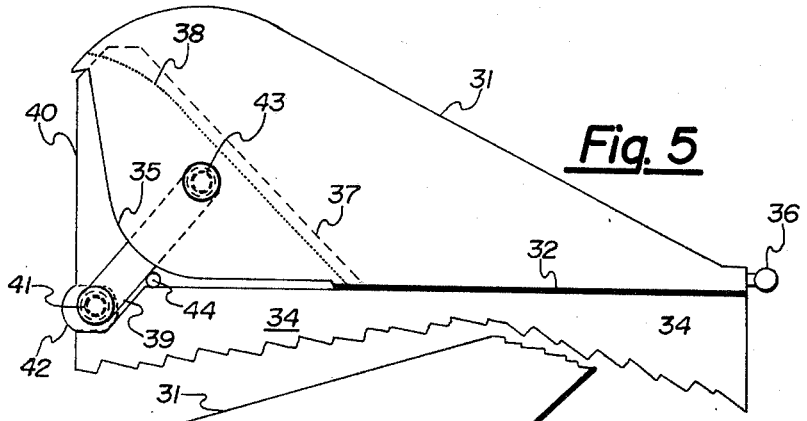
FIG. 5 is a side elevational view of another embodiment of the present invention in a closed position.
Figure 6:
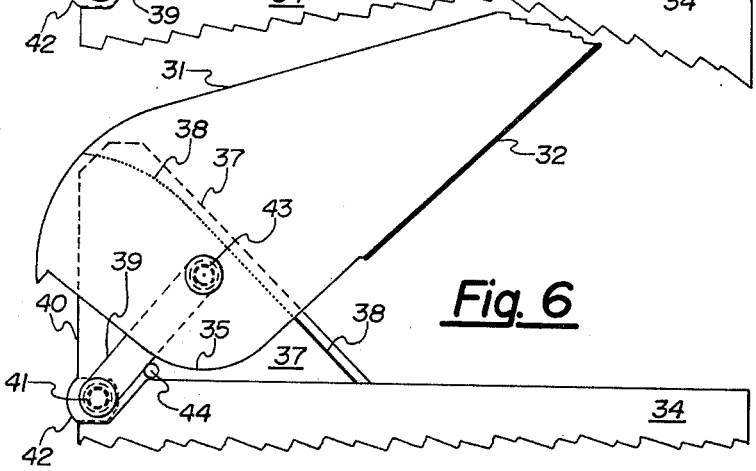
FIG. 6 is a side elevational view of the embodiment of FIG. 5 in a partially open stabilized position.
Figure 7:
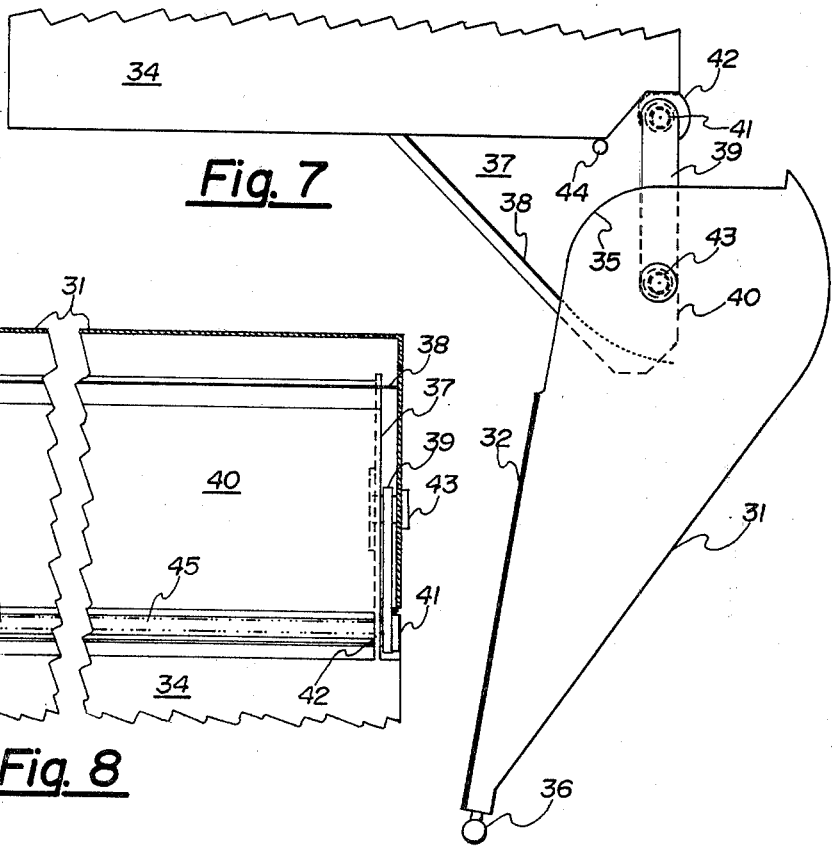
FIG. 7 is a side elevational view of the embodiment of FIG. 5 in an inverted position.

Referring to FIGS. 5, 6, and 7, a lid assembly 31 has a seal 32 resting on a top edge of bin 34. Lid 31 has a handle 36. Trash bin 34 has a raised portion 37 with a lip seal 38 carried thereby. Pivot arm 39 is rotatably coupled at one end to pivot point 41 on bracket 42 which is fixedly attached to trash bin 34. Pivot arm 39 is also rotatably coupled at pivot point 43 on the trash container lid 31. Pivot arm stop 44 extends outwardly from the sides of trash bin 34.

Figure 8:
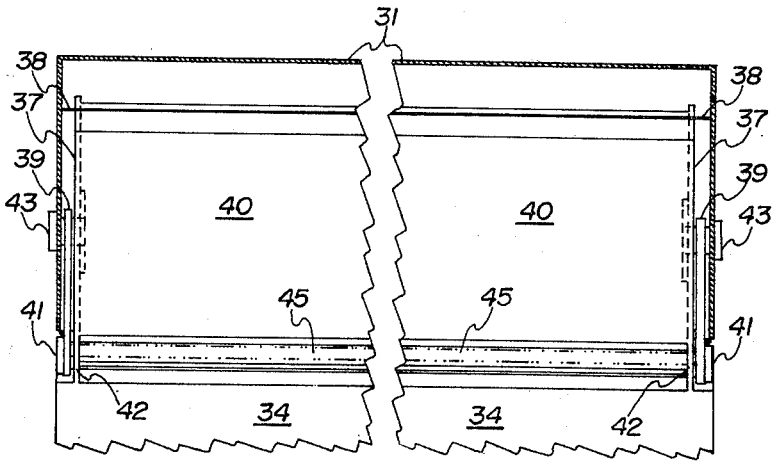
FIG. 8 is a back elevational view of the embodiment of FIG. 5 with the lid portion sectioned.

Referring to FIG. 8, lid 31 is shown in proximity with bin riser 40. Pivot arms 39 are shown with their upper ends pivotally attached to each side of lid 31 at pivot point 43 and their lower ends rotatably attached via axle tube 45 to fixed pivot brackets 42. Fixed pivot brackets 42 are fixedly attached to the back surface of bin 34. Tube 45 extends through fixed pivot brackets 42 and is coupled directly to pivot arms 39.

OPERATION

Referring back to FIGS. 1 and 2, it can be seen that as handle 13 of lid assembly 11 is pushed to the rear and upward, the lid will roll backwards on lid roller 14 to stop 17 while the back portion will describe an arch dependent upon the length and positioning of pivot arm 19. When lid section roller 14 reaches stop 17 on trash bin 12, the counterweight 18 holds the lid in a partially opened position as shown in FIG. 2. At this time trash can be conveniently dumped into bin 12. When it is desired to close lid 11, handle 13 is merely pulled in a downward and/or forward direction, resulting in its return to the position shown in FIG. 1. At the time of emptying trash bin 12 in the conventional manner, whereby it is lifted over a dump truck's cab and inverted, it will assume the position shown in FIG. 3 with lid section 11 in a downward and fully open position and lever arm 19 against angle bracket 17A.

Referring to FIGS. 5 and 6, a modification is shown whereby the lid rollers have been eliminated and the lid is opened by raising it to the position shown in FIG. 6 whereby the top surface of bin 34 will be tangential to lower surface 35 of lid 31 allowing it to rest thereon and remain in the partially open position shown in FIG. 6. This is similar to the partially open position [stabilized] of the above-referenced application Ser. No. 330,569 filed Feb. 8, 1973 by Allan M. Hodge. When dumping bin 34 it is again inverted over a dump truck bed and will be in the position shown in FIG. 7. Here pivot arm 39 is in a vertical position and lid 31 is also extending vertically and downwardly therefrom, allowing a complete emptying of trash bin 34. Hence, it can be seen that due to use of a double pivot arm, a stabilized partial open position of a trash container lid and fully opened inverted position has been realized with a minimum of parts and effort to the user.

It should be understood, of course, that the foregoing disclosure relates to only a preferred embodiment of the invention and that it is intended to cover all changes and modifications of the example of the invention herein chosen for the purposes of the disclosure which do not constitute departures from the spirit and scope of the invention.

The invention claimed is:

1. A trash container lid system for use with large industrial trash bins in which the lid is rotatably coupled to the trash bin by means of a lever arm and is slidably coupled to the trash bin by means of a roller on the lid, comprising:

a trash bin having an upper edge;

a lid section having a lower edge dimensioned for cooperation with said trash bin upper edge;

first and second lever arms, said first and second lever arms each being rotatably coupled at one end to first and second pivot points, respectively, adjacent to opposite edges of said trash bin and rotatably coupled at their other end to third and fourth pivot points adjacent to corresponding edges of said lid section;

first and second rollers rotatably carried by said lid section adjacent to said corresponding edges;

first and second roller tracks on the top of said opposite edges of said trash bin, said first and second roller tracks rotatably carrying said first and second rollers; and a raised portion at the back termination of said first and second roller tracks, to stop the rearward movement of said lid section when it is raised rearwardly for the purpose of opening said bin to receive trash; whereby said lid can remain in a stabilized partially open position.

2. The trash container lid system of claim 1 wherein: said lid section includes means operable for holding said lid in a partially open position.

3. The trash container lid system of claim 2 wherein: said holding means includes a counterweight coupled to said lid section.

* * * * *